US006276984B1

(12) United States Patent
Komaba

(10) Patent No.: US 6,276,984 B1
(45) Date of Patent: Aug. 21, 2001

(54) BALLOON

(76) Inventor: Kunio Komaba, 2-2-5 Morishita, Koto-ku, Tokyo (JP), 135-0004

( * ) Notice: Subject to any disclaimer, the term of this patent is extended or adjusted under 35 U.S.C. 154(b) by 0 days.

(21) Appl. No.: 09/504,148

(22) Filed: Feb. 15, 2000

(30) Foreign Application Priority Data

Apr. 15, 1999 (JP) ..... 11-108642

(51) Int. Cl.[7] ..... A63H 3/06
(52) U.S. Cl. ..... 446/223; 446/220
(58) Field of Search ..... 446/220, 221, 446/223, 226, 222, 224, 225; 600/115, 116; 604/95.03, 101.01, 101.05, 103.07

(56) References Cited

U.S. PATENT DOCUMENTS 2,028,797 * 1/1936 Miller ..... 446/226
4,934,986 * 6/1990 Wallace ..... 446/220
4,953,713 * 9/1990 Yaffe ..... 446/221
5,169,353 * 12/1992 Myers ..... 446/221
5,653,272 * 8/1997 McCaul ..... 446/220
5,769,683 * 6/1998 Park ..... 446/220
6,048,591 * 4/2000 Zweibel ..... 446/220
6,050,874 * 4/2000 Ries ..... 446/220

* cited by examiner

*Primary Examiner*—Sam Rimell
(74) *Attorney, Agent, or Firm*—Pennie & Edmonds LLP

(57) ABSTRACT

A balloon having a balloon body and pieces protruded from the balloon body; an adhering member is formed on the surface of each of the protruded pieces. Balloons according to the invention can be continuously connected to each other by means of the adhering member formed on the protruded pieces, so that a display constituted of balloons can be designed freely in shape and in size without using a frame member or a supporting member.

8 Claims, 6 Drawing Sheets

BALLOON

BACKGROUND OF THE INVENTION

1. Field of the Invention

The present invention relates to a balloon, and particularly, relates to a balloon for show entertainment use. Balloons according to the invention, can be easily continuously connected together to obtain a display constituted of a plurality of balloons, where the balloons are connected not only in a two dimensional directions but also in a three-dimensional directions.

2. Related Art Statement

FIG. 1 is a schematic view showing a state that a plurality of balloons 12 are continuously connected to be displayed in a conventional manner for entertainment purpose. A pipe rod frame 10 having lattice spaces 11 is provided for holding the balloons 12 in the lattice spaces 11, respectively, to complete the display.

FIGS. 2(*a*) and 2(*b*) show another conventional way to continuously connect a plurality of balloons for display purposes. As shown in FIG. 2(*a*), each balloon 13 has a hole 15 in the flap portion 14 thereof so that a string or a pipe 16 can be inserted through the hole 15 to hold them, and the balloons are collected together to be displayed in a manner shown in FIG. 2(*b*).

These conventional displays, however, have drawbacks mentioned below. In case that a frame having lattice spaces is used to display the balloons, it is required to previously build up the frame in the place where the balloons are displayed. Therefore, it costs for preparing the frame 10, i.e. a labor cost for transporting the frame 10 to the place to display the balloons 13, for assembling the frame 10 and for removing the frame after the event finishes, in addition to the manufacturing cost of the frame. Further, in order to build up a big display, stable ground is required because of the weight of the frame 10.

While, in case that a pipe is used to display the balloons, a display extended in a longitudinal direction as shown in FIG. 2(*b*) can be completed easily, however, it is not easy to achieve a display extended in a two- or three-dimensional manner.

Furthermore, according to the conventional methods, the rough shape of the display as a whole is preliminarily determined by the frame 10 or the pipe 16 and it is not so easy to change the design of the display. Therefore, the free degree is very small in designing the shape of a display as a whole.

SUMMARY OF THE INVENTION

The present invention has for its purpose to provide balloons use for entertainment and show purposes, in which the above-mentioned drawbacks are solved, so the balloons can be displayed freely both in size and shape without using any frame member or any supporting member such as a pipe rod and a string.

In order to solve the above drawbacks, the balloon according to the present invention comprises a balloon body, at least one piece being protruded from said balloon body for connecting said balloon to another balloon, and an adhering means being provided on said protruded piece, wherein said balloon is connected to another said balloon by means of the adhering means.

The balloon may comprise a plurality of pieces protruded from said balloon body for connecting said balloon to another balloon, and said adhering means is provided on each of the pieces for connecting said balloon to still another balloon.

According to such a construction of the balloon, balloons can be connected to each other in a continuous manner and thus a two- or three dimensional display of balloons is easily completed.

The balloon may further comprise an adhering means being provided on said balloon body itself. According to the balloon, since the adhering means is not only on the protruded pieces but also on the balloon body itself, it becomes easier to constitute a three-dimensional display of balloons.

A preferred embodiment of the balloon according to the present invention comprises a balloon body, at least two strings being fixed to said balloon body for connecting said balloon to other balloons.

In this case, it is preferred that the balloon further comprises an adhering means being provided on said balloon body itself for connecting said balloon to still another balloon.

DETAILED EXPLANATION OF THE PREFERRED EMBODIMENTS

Figure 1:
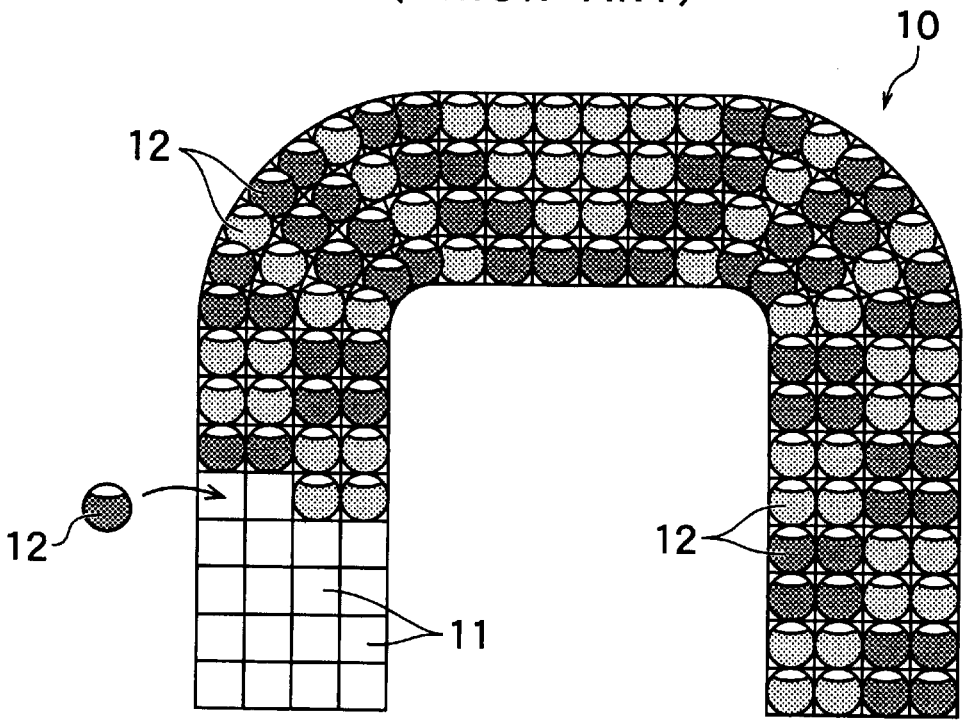
FIG.1 (PRIOR ART)
FIG. 1 is a schematic view showing a construction of a conventional display constituted of balloons.
Figure 2A:
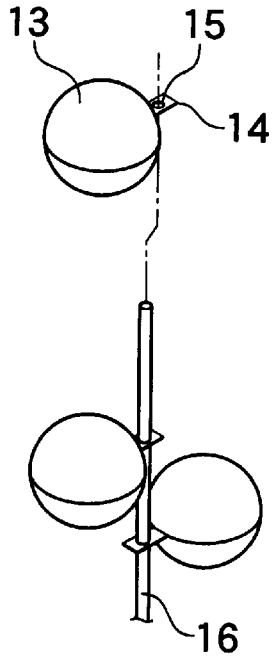
FIG.2(a) (PRIOR ART)
FIGS. 2(*a*) and 2(*b*) are schematic views depicting a construction of another conventional display constituted of balloons.
Figure 2B:
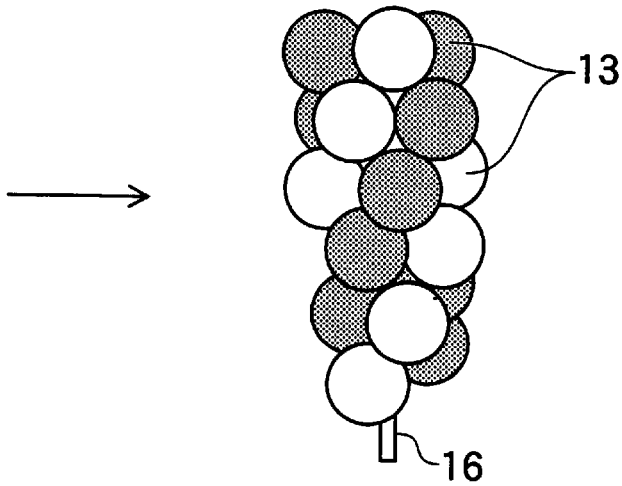
FIG.2(b) (PRIOR ART)
Figure 3:
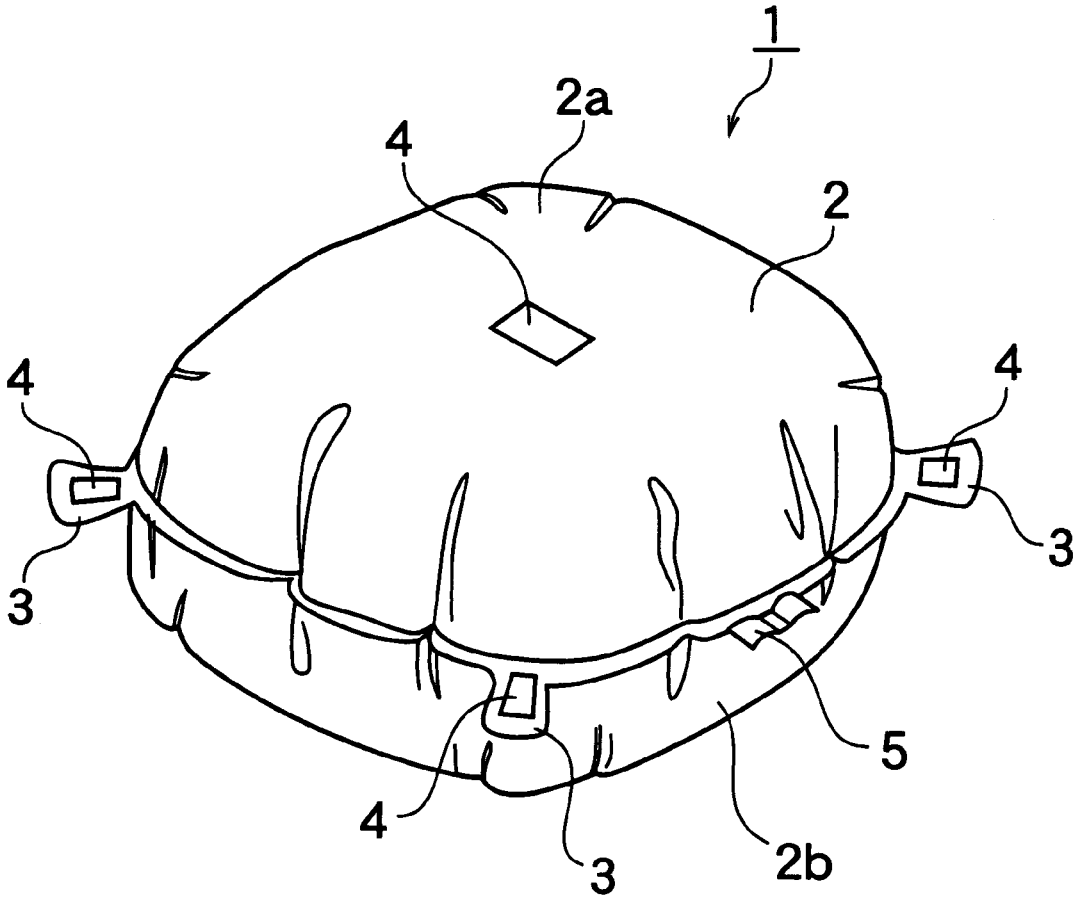
FIG. 3 is a perspective view illustrating a construction of the first embodiment of a balloon according to the present invention.
Figure 4A:
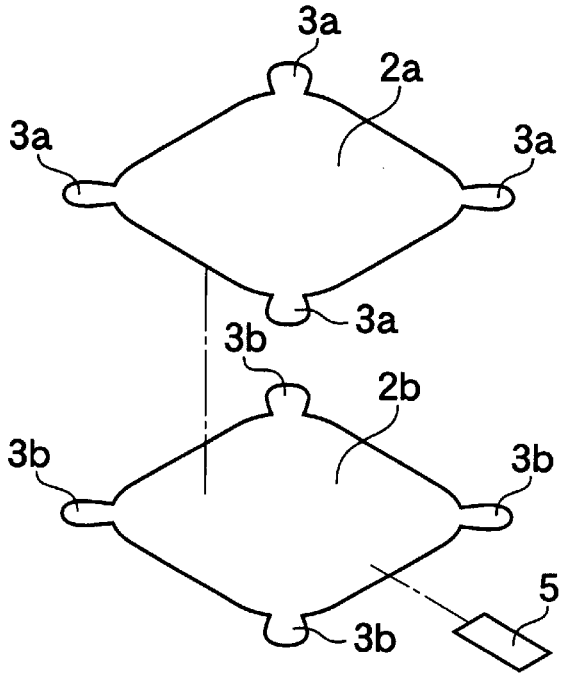
FIGS. 4(*a*) to 4(*c*) are schematic views representing a process for manufacturing the balloon according to the present invention.
Figure 4B:
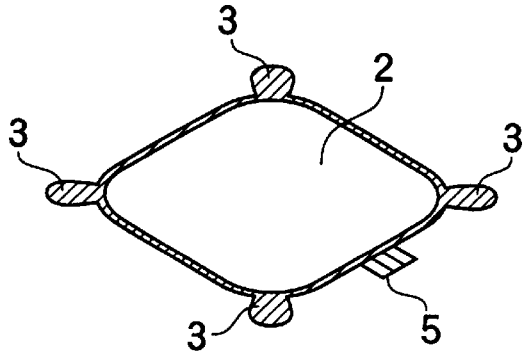
Figure 4C:
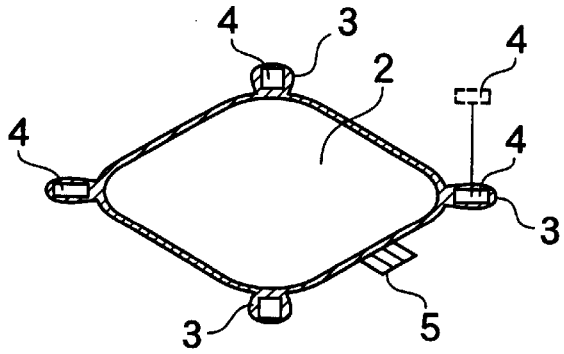

FIG. 3 is a perspective view showing the shape of a balloon according to the present invention and FIGS. 4(*a*) to 4(*c*) are schematic views illustrating a process for manufacturing the balloon. As shown in FIG. 3, the balloon 1 comprises a balloon body 2 constituted of a front member 2*a* and a rear member 2*b*, both of which have a rectangular shape, respectively. As illustrated in FIGS. 4(*a*) to 4(*c*), the rectangular-shaped front and rear members 2*a* and 2*b* are superimposed and then the peripheral portions thereof are melt-bonded together. The front and rear members 2*a* and 2*b* have a protruded piece 3 at each corner thereof for use in connecting the balloon 1 to other balloons. According to this embodiment, the protruded pieces 3 are formed with the front and rear members 2*a* and 2*b*, respectively, as a united body thereof. On at least one of the surfaces of each of the protruded pieces, which are bonded together, is provided a bonding means 3, i.e. a both-surfaces adhering tape, which may be stuck on the surface of a protruded piece of another balloon. When connecting balloons together, a thin paper on the top of the tape should be stripped therefrom and the top side of the tape is stuck to a protruded piece of another balloon so as to connect both balloons together.

It should be noted that the numerical reference 5 represents a gas injection valve, and the hatched portion shows a melt-bonded portion. The gas injection valve 5 is constituted of known non-return valve, which comprises superimposed two films, both longitudinal sides of which are melt-bonded together so as to form a gas injection path therebetween. A thin pipe is inserted into the path and a gas is injected into the balloon through the pipe. When the pipe is removed, the films adhere together so closely that the return of the gas can be prevented.

On each protruded piece 3, a both-surfaces adhering tape 4 is provided so that it makes possible to connect the balloon 1 to another balloon.

Figure 5:
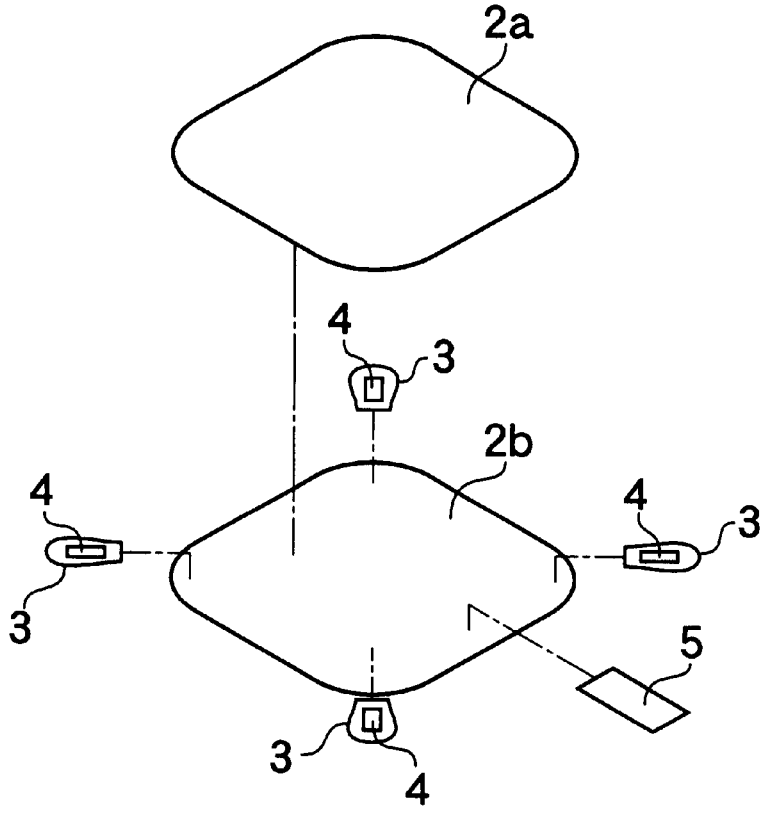
FIG. 5 is an exploded schematic view showing a construction of a modification of the balloon illustrated in FIG. 3.
Figure 6:
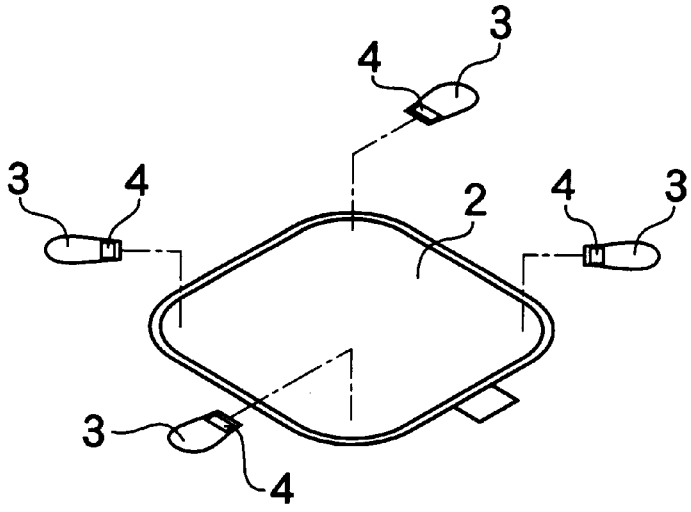
FIG. 6 is an exploded schematic view shown in an exploded manner depicting a construction of another modification of the balloon illustrated in FIG. 3.

FIGS. 5 and 6 are schematic views showing modifications of the balloon according to the present invention. In the modification shown in FIG. 5, the protruded pieces 3 are prepared separately from the balloon body 2, and put between the front and rear members 2*a* and 2*b* to be melt-bonded together. Alternatively, it may be possible that the protruded pieces 3 are stuck to the surface of the balloon body 2 after the front and the rear members 2*a* abd 2*b* are bonded together, as shown in FIG. 6.

Figure 7:
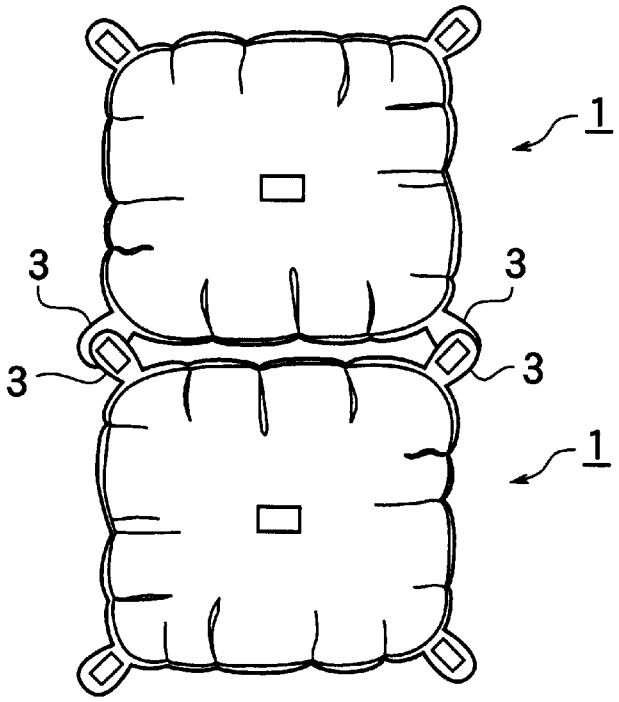
FIG. 7 is a schematic view for explaining how to connect a plurality of balloons according to the invention.
Figure 8:
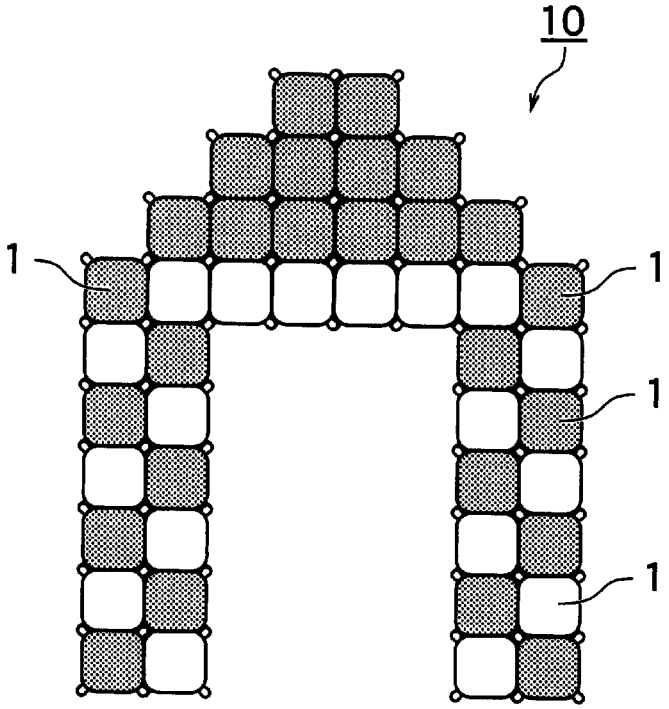
FIG. 8 is a schematic view illustrating an example of the display constituted of balloons according to the invention.

Next, how to use the balloons of the invention will be explained. First, a gas like Helium, which is lighter than an air, is injected into the balloon through the injection valve to inflate the balloon. The thin paper covering the both surfaces adhering tape provided on the surface of the protruded pieces 3 of the inflated balloon is removed off; then the protruded piece 3 is adhered to a protruded piece of the other balloon. By selecting the protruded piece(s) to be bonded to the other balloon, balloons are connected together so as to obtain a display having a desired shape as shown in FIGS. 7. A plurality of balloons are continuously connected together in the same manner. FIG. 8 shows a condition that a plurality of balloons are connected together to complete a certain-shaped display 10.

The display 10, which is completed in this manner, can be stood by itself without using a frame member or a supporting member because the gas injected in their bodies is lighter than an air. Therefore, provided a suitable weight(s) to the balloons located at the lowest position, the display as a whole does not move.

In the above-mentioned embodiment, the adhering means 4 is provided on the surface of the protruded piece 3. However, it is not limited to provide it on the protruded pieces 3, but an adhering means 4 may further be attached on the surface of the balloon body 2, as shown in FIG. 7. By the bonding means 4 attached on the surface of the balloon body 2 itself, not only a two dimensional display expanding in a upper and lower, left and right directions but also a three dimensional balloon display can be realized, so that the design of the balloon display can be performed more freely.

Figure 9A:
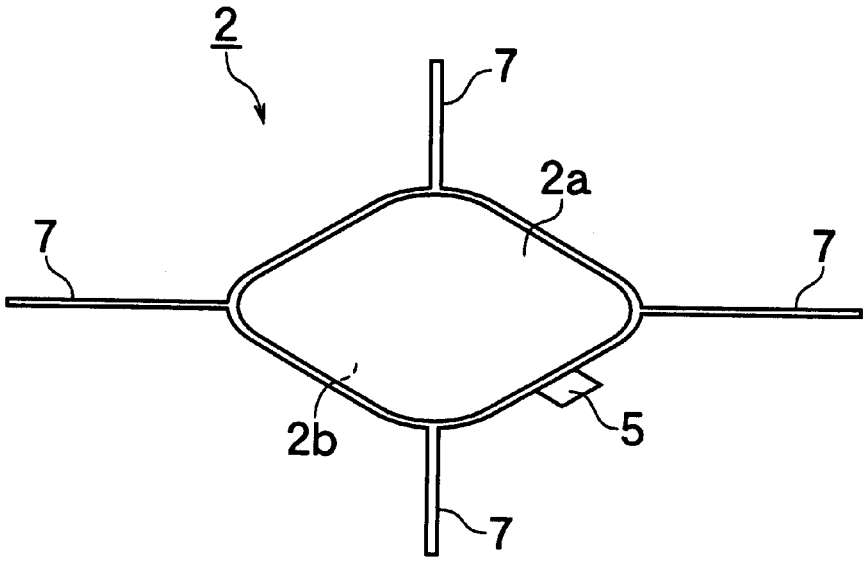
FIGS. 9(*a*) and 9(*b*) are schematic views representing a construction of the second embodiment of the balloon according to the present invention.
Figure 9B:
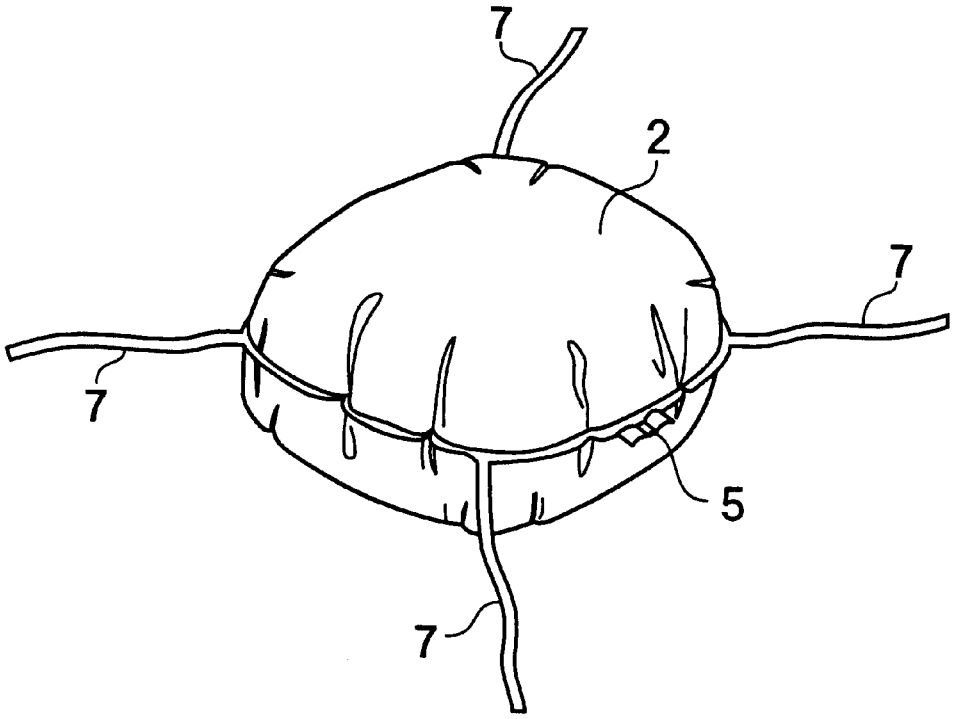

FIGS. 9(*a*) and 9(*b*) show a construction of another embodiment of balloons according to the invention. In this embodiment, connecting strings 7 are provided at each corner of the balloon body 2 instead of the connecting pieces 3. As the same as the first embodiment, the connecting strings 7 may be provided with at least one of the front and rear members of the balloon body as a united body, or may be formed separately from the balloon body 2. In case the strings 7 are formed separately from the balloon body 2, they should be superimposed between the front and rear members and then melt-bonded together to be fixed to the balloon body 2.

In this embodiment, the connection of the balloons can be realized by tying up the strings 7 together after a gas is injected into the balloon bodies to make them inflated.

As explained above, according to the invention, the balloons can be connected together directly to realize a certain-shaped display via the bonding adherence formed on the protruded pieces 3 or via the strings 7 attached to the balloon body 2 without using any frame member or rod like supporting member. Since no frame or no rod is used, it becomes possible to design a display freely in size or shape. Further, a three-dimensional display can be realized easily, additionally provided a bonding means on the surface of the balloon body. In case that strings are provided on the balloon body, the balloons can be connected more certainly. Further, in the case of using the strings, since it is not necessary to provide a both-surface adhering tape, the manufacturing steps becomes simpler and the cost therefore can be saved.

In the above described embodiments four protruded pieces are shown, whoever it is possible to modify it so that only one piece is formed and could be attached to the balloon body of another balloon. In the case of using strings, at least two strings are necessary to connect one balloon to another balloon.

What is claimed is:

1. A balloon comprising:

a balloon body comprising two rectangular members bonded to each other to form a unitary rectangular balloon body with four corners, extension pieces protruding from said four corners of said unitary rectangular balloon body for connecting said balloon to other balloons, and adhering means being provided on each of said extension pieces for connecting said balloon to other balloons.

2. A balloon comprising:

a balloon body being constituted of two rectangular members which are bonded together to form a unitary rectangular balloon body with four corners;

extension pieces being protruded from each of said four corners of said unitary rectangular balloon body for connecting said balloon to another balloon; and adhering means being provided on each of said extension pieces and on a central portion of said unitary rectangular balloon body for connecting said balloon to other balloons.

3. A balloon comprising:

a balloon body comprising two rectangular members bonded to each other to form a unitary rectangular balloon body with four corners, extension pieces protruding from said four corners of said unitary rectangular balloon body for connecting said balloon to other balloons, and an adhering member being provided on each of said extension pieces for connecting said balloon to other balloons.

4. The balloon of claim 3, wherein said adhering member comprises an adhering tape.

5. The balloon of claim 4, wherein said adhering tape comprises a double-sided adhering tape.

6. The balloon of claim 3, wherein each extension piece and its correspond adhering member are integrated as a string member.

7. The balloon of claim 3 further comprises a adhering member provided on said balloon body.

8. The balloon of claim 3, wherein said balloon is inflated with a gas lighter than air.

* * * * *